United States Patent [19]

Bussell

[11] Patent Number: 4,614,574

[45] Date of Patent: Sep. 30, 1986

[54] IMPRESSED CURRENT ANODE BED

[75] Inventor: Roland E. Bussell, Greenwell Springs, La.

[73] Assignee: The Dow Chemical Company, Midland, Mich.

[21] Appl. No.: 805,670

[22] Filed: Dec. 6, 1985

[51] Int. Cl.[4] ..... C23F 13/00

[52] U.S. Cl. ..... 204/196; 204/286; 204/297 R

[58] Field of Search ..... 204/147, 148, 196, 197, 204/286, 297 R, 297 W

[56] References Cited

U.S. PATENT DOCUMENTS

| | | | |
|---|---|---|---|
| 2,838,453 | 6/1958 | Randall | 204/197 |
| 2,856,342 | 10/1958 | Van Der Hoeven et al. | 204/197 |
| 2,910,419 | 10/1959 | Preiser et al. | 204/196 |
| 2,910,420 | 10/1959 | Preiser | 204/196 |
| 3,278,404 | 10/1966 | Cotton et al. | 204/196 |
| 3,718,554 | 2/1973 | Jacobs et al. | 204/196 |
| 3,718,570 | 2/1973 | Geld | 204/196 |
| 4,171,254 | 10/1979 | Koenecke | 204/197 |
| 4,172,023 | 10/1979 | Friedli et al. | 204/286 |
| 4,492,877 | 1/1985 | Staerzl | 204/196 |

FOREIGN PATENT DOCUMENTS

| | | | |
|---|---|---|---|
| 614799 | 12/1948 | United Kingdom | 204/196 |
| 2118974A | 11/1983 | United Kingdom | 204/196 |

*Primary Examiner*—T. Tung
*Attorney, Agent, or Firm*—D. R. Howard

[57] ABSTRACT

This invention relates to an impressed current anode bed. The anode bed has a housing which is a truncated, four-sided pyramid having a rectangular base. The housing has a cavity extending from its base to its apex. At least one anode is mounted to the housing and located within the cavity. The anode is connected to a source of DC electrical current. At least one channel extends from one exterior side to an opposite exterior side of the housing and through the cavity. The channel is closer to the base than the anode.

19 Claims, 5 Drawing Figures

IMPRESSED CURRENT ANODE BED

BACKGROUND OF THE INVENTION

This invention relates to an impressed current anode bed which provides for anchoring anodes on the bottom of a body of water. The anode bed is configured to resist movement from the original anchored position and to resist buildup of solids, e.g., silt, around the anodes.

Two common methods for providing cathodic protection for minimizing corrosion of metals submerged in a liquid electrolyte, e.g., sea water, fresh water, etc., are the sacrificial-anode method and the impressed current method. In both methods, an electrical current is generated to make the submerged metal act as the cathode in the system. The sacrificial-anode method places the anode in the electrolyte and generates the required electrical current by corrosion of the anode material. This method is not always the method of choice as replacement of the sacrificed anodes can be very expensive. This is especially true in those cases where the metal to be protected is a portion of an offshore oil platform, a wharf or a bridge which is located in a deep or fast-moving body of water. In these cases, the impressed current method is usually more attractive.

In the impressed current method, the electrical current is provided by an external DC current source. This DC current is provided to an essentially non-sacrificial anode which is submerged in the electrolyte and located in proximity to the metal to be protected. The prior art teaches that the anode can be: of the composite type, e.g., an LIDA anode, manufactured by Oronzio De Nora, S.A., Lugano Switzerland; of an iron alloy, e.g., an iron-silicon-chrome alloy; of a graphite composition; or of a precious metal such as platinum. The composite type and the graphite composition type are provided in lightweight tubular form while the iron alloy is generally provided as a heavy rod. Most often a plurality of anodes are used together in a group and, in any particular group, they are electrically connected together.

Submerging and locating the anode(s) in proximity to the metal to be protected is conveniently achieved by providing an anode bed which has an overall specific gravity greater than that of the electrolyte. An inexpensive anode bed, and one which is widely used, comprises two long logs and the anodes which are all assembled to form a ladder-like structure with the logs being the legs and the anodes being the ladder rungs. If the anodes are heavy, e.g., the iron alloy type, they will supply the submerging ballast. If, on the other hand, lightweight anodes are used, e.g., the composite type, then concrete columns can be substituted for the logs which will assure submergence of the bed. The electrical connection between the anodes is by way of anode end seals and connecting wires, all of which are exposed to the electrolyte. This type of bed is generally satisfactory for use in those bodies of water were high solids concentrations and fast currents, at the bed location, are not a problem. High solids concentrations are troublesome as this bed configuration sufficiently slows the current so that solids carried by the current will fall out and buildup about the bed. This solid buildup is particularly detrimental when the anode surfaces become covered so that they lose their capacity to generate the needed electrical current. The presence of fast water currents, i.e., currents of 10 to 20 mph (16 km/hr to 32 km/hr), can be troublesome as these currents can move solids, e.g., silt, sand, etc., into erosive contact with the exposed anode end caps and connecting wires which results, over time, in their failure.

Therefore, it is an object of this invention to provide an impressed current anode bed which is highly resistant to an accumulation of solids which would otherwise cover the anode surfaces. It is also an object of this invention to provide such a bed which protects against erosion of the electrical connections between the anodes.

THE INVENTION

The impressed current anode bed of this invention features a housing which forms a truncated, four-sided pyramid having a rectangular base. The housing additionally includes a cavity which extends from the apex of the truncated pyramid to its base. At least one anode is mounted to the housing and located within the cavity. The anode is connected to a source of DC electrical current, which source is most often remotely located from the anode bed. The anode should be mounted within the cavity so that it is below the horizontal plane through the apex of the truncated pyramidal housing. By so locating the anode, it will be at least partially shielded from errosive contact with solids carried by any liquid current flowing over the anode bed. At least one channel extending from one exterior side to a opposite exterior side of the housing and through the cavity is also provided. The channel is located below the anode and above the housing base.

In most instances, a plurality of anodes will be utilized and when so utilized, these anodes will be connected either in parallel or in series with the source of DC electrical current. Most commercially available anodes are elongated in configuration. Whether used singularly or plurally, it is preferred that the elongated anode(s) be mounted to the housing so that their longitudinal axis is substantially parallel to one side of the housing base. When a plurality of anodes are used, it is preferred that they have their longitudinal axes lying substantially in a single plane which is substantially parallel to the housing base.

The rectangular base of the housing can either have its adjacent sides equal or unequal, the selection of either relationship being dependent at least upon the length of the anodes and their number.

In a preferred form, the cavity in the housing has a rectangular horizontal cross-section throughout its extent. Most preferably, the upper extent of such a cavity is defined by the pyramid sides, at their respective apexes.

By the housing having a truncated, four-sided pyramidal shape, any liquid current flowing substantially parallel to the surface upon which the anode bed rests will strike the housing at an oblique angle of incidence. Thus, upon striking the housing, current speed will be reduced much less than would be the case for those anode bed structures which provided surfaces having angles of incidence of 90° or less. With the low reduction in current speed, the solids entrained in the current are less likely to fall therefrom and deposit around the housing to cover the anode surfaces. In a preferred form, the anode bed of this invention has surfaces which are at an angle within the range of from about 30° to about 45° with the base of the housing thereby providing an angle of incidence for the current within the range of from about 150° to about 135°. Also, the oblique angles of incidence provided by the housing reduce the force applied by the current on the anode bed, which force might otherwise tend to move it from its original position.

The channel(s) provided by the anode bed of this invention further reduce the force applied by the current on the anode bed as a portion of the current is allowed to flow through the housing. Just as important, the channel(s), by allowing a portion of the current to flow therethrough, additionally provide a mechanism for washing from the cavity any solids which may start to accumulate therein.

These and other features of this invention contributing to satisfaction in use and economy in manufacture will be more fully understood from the following description and figures in which identical numerals refer to identical parts and in which.

Figure 1:
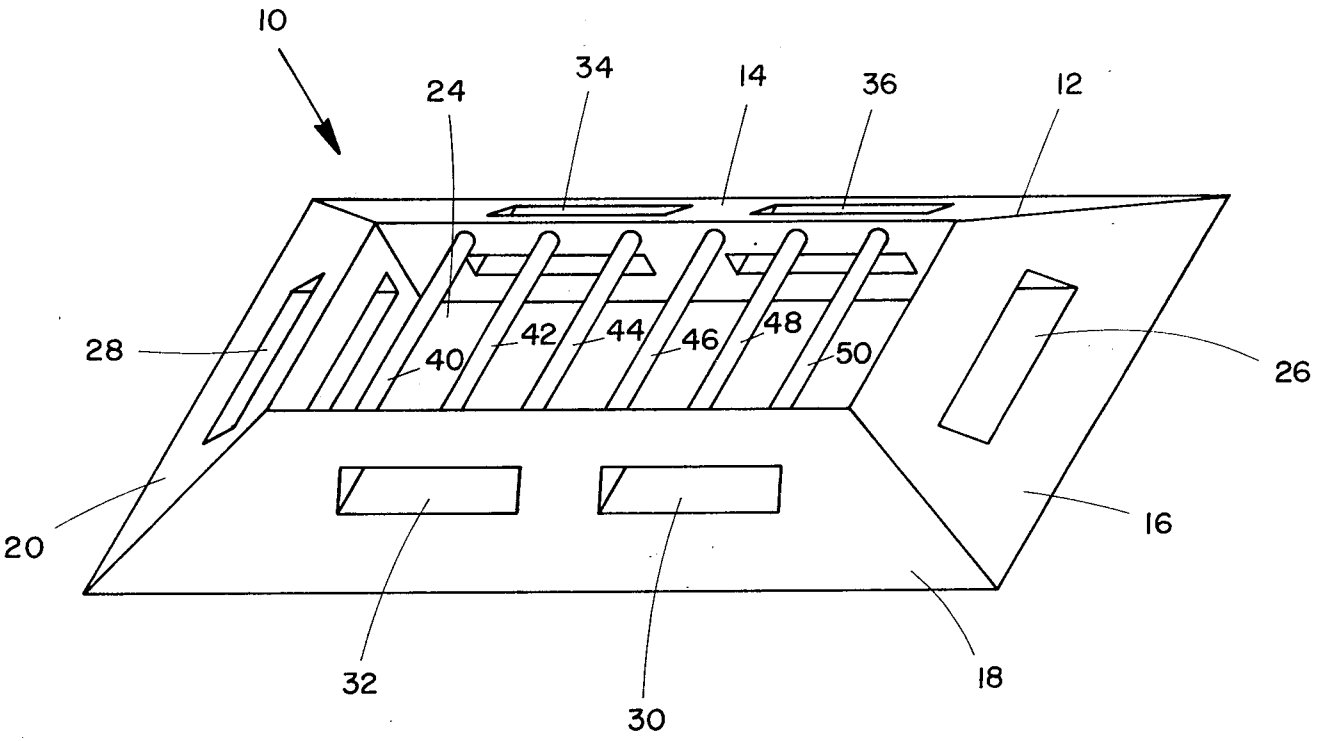
FIG. 1 is a perspective view of an impressed current anode bed of this invention.
Figure 2:
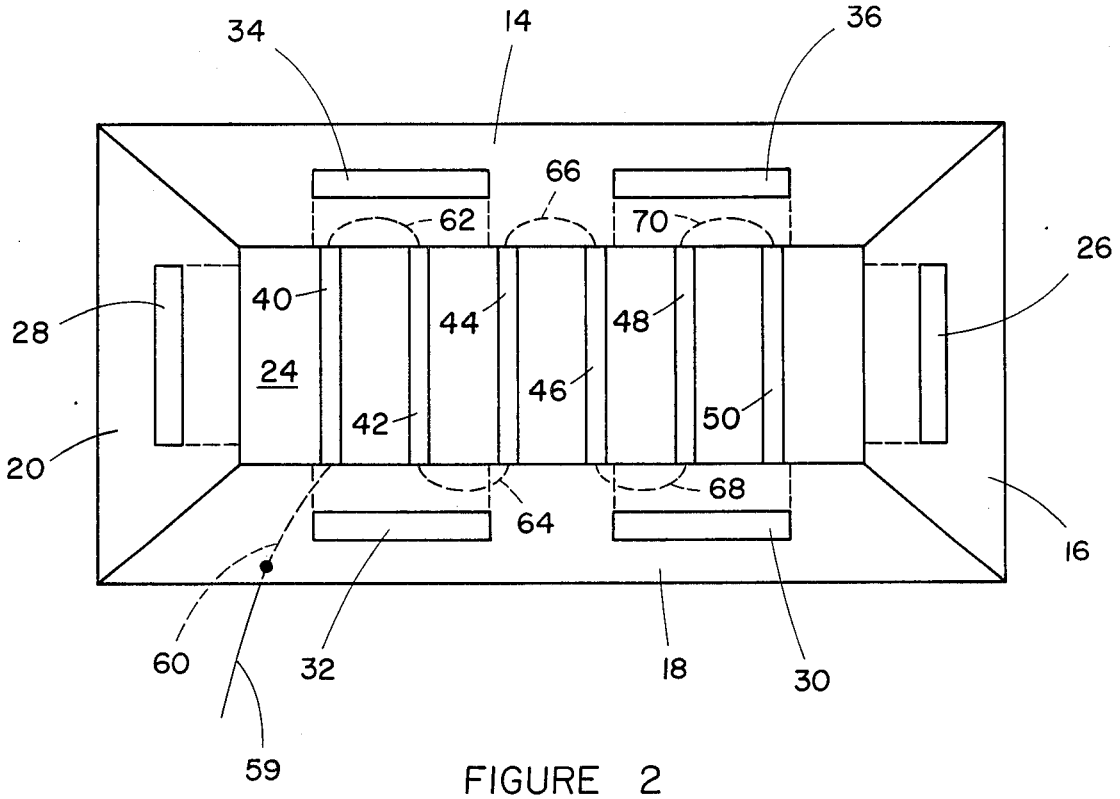
FIG. 2 is a top plan view of the anode bed shown in FIG. 1.

Referring now to the drawings, there can be seen an impressed current anode bed of this invention, generally designated by the numeral 10. Anode bed 10 includes a housing 12 which has the configuration of a truncated, four-sided pyramid having a rectangular base 22. For the embodiment shown in the drawings, rectangular base 22 is one in which its adjacent sides are of unequal length.

Sides, hereinafter referred to as faces, of housing 12 form two sets of opposing faces, one set being side faces 14 and 18 and the other set being end faces 16 and 20. For the embodiment shown, side faces 14 and 18 are of a longer length than end faces 16 and 20.

Extending from rectangular base 22 to the apex of housing 12 is cavity 24. Cavity 24, as can be seen from the drawings, has a constant rectangular horizontal cross-section throughout its extent.

Three channels are provided by housing 12, two extending from side face 18 to side face 14 and one extending from end face 16 to end face 20. The two channels which extend from side face 18 to side face 14 also extend through cavity 24 and traverse its longitudinal axis. The channel from end face 16 to end face 20 also extends through cavity 24 but is in the direction of the longitudinal axis of cavity 24. One of the channels extending from side faces 18 and 14 is partially provided by channel port 32 on side face 18 and channel port 34 on side face 14. The other channel extending to side faces 18 and 14 is partially provided by way of channel port 30 on side face 18 and channel port 36 on side face 14. The channel which extends from the two end faces is partially provided by channel port 26 on end face 16 and channel port 28 on end face 20.

Figure 3:
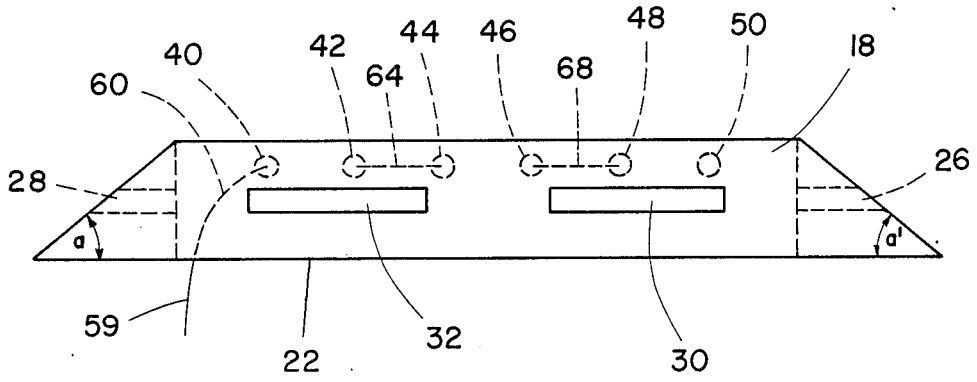
FIG. 3 is a side elevational view of the anode bed shown in FIG. 1.
Figure 4:
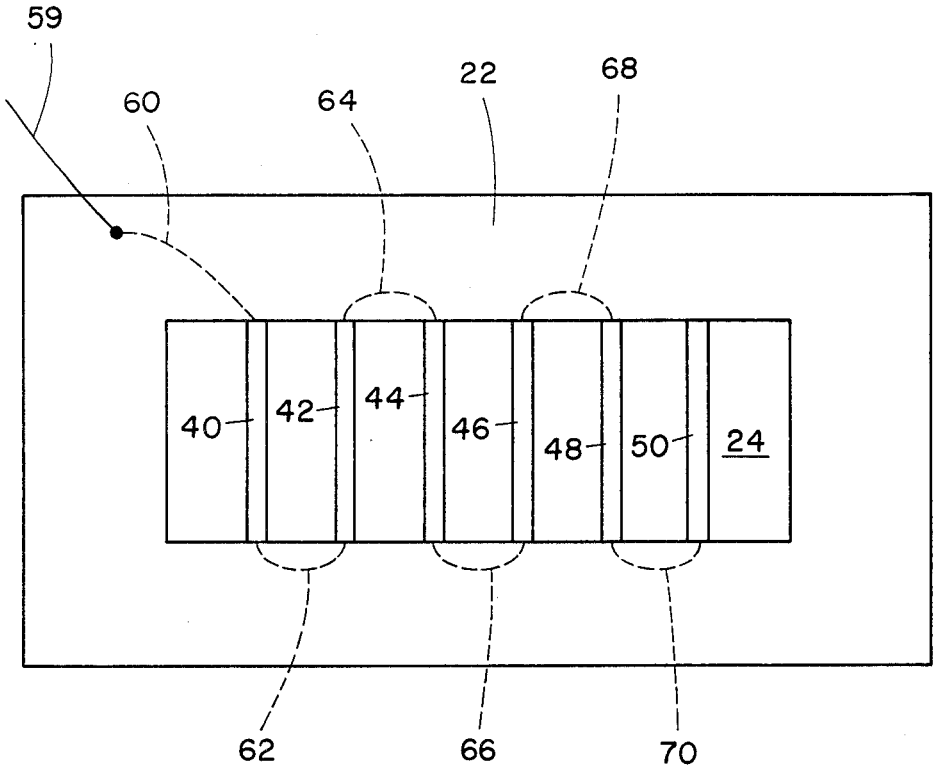
FIG. 4 is a bottom plan view of the anode bed shown in FIG. 1.

Located within cavity 24 are anodes 40, 42, 44, 46, 48 and 50. These anodes can be of any of the types which are used as impressed current anodes. This array of anodes is arranged so that the longitudinal axis of each anode lies substantially in a single plane which in turn is substantially parallel to the plane of base 22. Also, the longitudinal axes of these anodes traverses the longitudinal axis of cavity 24. This arrangement of the anode array is a preferred arrangement; however, other array arrangements can be utilized. The anodes are held in position within cavity 24 by having their ends set in the material of construction for housing 12. If housing 12 is of concrete, the anode ends are placed into position before the concrete is poured or hardens. Also located within the material of housing 12 are the electrical cables which connect the anodes in either a series or parallel fashion. In serial connection, electrical cable 70 connects anodes 48 and 50, electrical cable 68 connects anodes 48 and 46, electrical cable 66 connects anodes 46 and 44, electrical cable 64 connects anodes 44 and 42, and electrical cable 62 connects anodes 42 and 40. The unconnected end of anode 40 is attached to electrical cable 60 which extends to base 22 as can be seen in FIG. 3. If a parallel type connection is used, the electrical connections are the same as above except that each pair of anodes are connected electrically to one another at both of their ends. Unconnected end of anode 50 would have an electrical cable extended from it and suitably connected to electrical cable 60. Extending outward from base 24 is terminal end 59 of electrical cable 60. Terminal end 59 is in turn connected to a shielded electrical cable which can be buried for protection against erosion and which runs to a point in proximity to the DC electrical currents source. From this point, the cable can be carried within a shielding conduit to the D.C. electrical source. By having the electrical cables and the anode ends encased within the material of which housing 12 is made, these component parts are protected from errosive wear caused by the impacting of solids carried by the water current flowing around, over and through anode bed 10. To protect the exposed outer surfaces of the anodes from such errosive wear, it is preferred that they be located a few inches/centimeters below the apex of housing 12. Thus, the water current is less likely to impact the anode surfaces directly.

Figure 5:
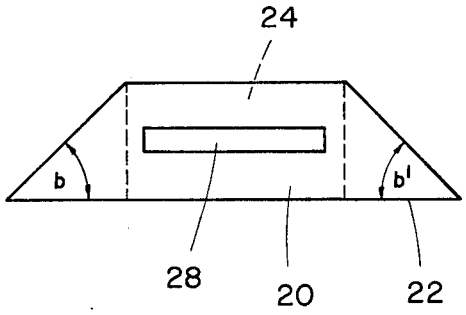
FIG. 5 is an end elevational view of the anode bed shown in FIG. 1.

The dimensioning of housing 12 and the dimensioning and configuring of the above-discussed channels and cavity 24 is dependent upon the length and the number of the anodes used and the sea bed conditions around anode bed 10. Thus, considerable latitude is given in designing anode bed 10. The design of anode bed 10 should be such that: (1) it provides faces which yield an oblique angle of incidence for the water current hitting the faces; (2) there are channels extending from on face to its opposite face and through cavity 24 to serve to dissipate some of the force of the water current on anode bed 10 and to cause part of the water current to wash out some of the solids which are settling out beneath the anodes; and, optionally, (3) the anode ends and their electrical connections are totally shielded from contact from the erosion caused by the water current. The selection of the angles that the faces of housing 12 form with rectangular base 22 is partially based upon the overall permissible dimensions of base 22, anode length, the height which the anodes are desired to be located above base 22 and upon the expected speed of the water current. If the water current is fairly slow, then the angles a, a', b and b' shown in FIGS. 3 and 5 can be greater than would be case if the current speed was high, i.e., 10 to 20 mph (16 km/hr to 32 km/hr). The configuration for channel ports 26, 28, 30, 32, 34 and 36 can be any which provides for a good flow therethrough of a water current which encounters such ports. Cavity 24 need not be rectangular, it can be cylindrical or any other shape which assures good water contact with the surface of the anodes. Also, cavity 24 need not be defined by the edges of the faces at their apexes but rather by other boundaries which are cut into a top face of housing 12 which top face is defined by the housing faces at their apexes. Further, in some circumstances, it may be desirable to locate the anode array so that the longitudinal axis of the anodes will be parallel to the longitudinal axis of the cavity.

A particularly suitable anode bed which would be of service in an area such as Cook Inlet in Alaska would have a base measuring 33 feet (9.5 meters) on two opposing sides and 11.75 feet (3.6 meters) on the other two opposite sides. Angles a, a', b and b' would be within the range of from about 20° to about 45°. Cavity 24 would have a height of 4 feet (1.22 meters) from base 22 and have two opposing sides measuring 33 feet (7 meters) in length with the other two opposing sides measuring 2.75 feet (0.84 meters) in length. The anodes would have a length of about 3.28 feet (1 meter), number 6 in all and be separated one from the other by about 3.28 feet (1 meter). Channel ports 26, 28, 30, 32, 34 and 36 would have their lower edges located about 1 foot (0.3 meters) from base 22 and be rectangular in shape. These channel ports would have opposing sides measuring about 1 foot (0.3 meters) with the other two opposing sides measuring about 6 feet (1.83 meters). The housing would be of concrete.

I claim:

1. An impressed current anode bed which comprises:

(a) a housing which forms a truncated four-sided pyramid having a rectangular base, said housing having a cavity extending from its apex to its base;

(b) at least one anode mounted to said housing and located within said cavity, said at least one anode being connected to a source of DC electrical current; and (c) at least one channel extending from one exterior side to an opposite exterior side of said housing and through said cavity, said channel being closer to said base than said at least one anode.

2. The bed of claim 1 wherein said rectangular base has adjacent sides of equal length.

3. The bed of claim 1 wherein said rectangular base has adjacent sides of unequal length.

4. The bed of claim 1 wherein there are a plurality of anodes which are in serial or parallel electrical connection with said source of DC electrical current.

5. The bed of claim 1 wherein said at least one anode is elongated and has its longitudinal axis substantially parallel to one side of said base.

6. The bed of claim 4 wherein there are a plurality of anodes, said anodes being elongated and having their longitudinal axes lying substantially in a single plane and substantially paralleling one side of said base, said single plane being substantially parallel to said base.

7. The bed of claim 6 wherein said rectangular base has adjacent sides of unequal length and wherein said longitudinal axes parallel the shorter of said adjacent sides.

8. The bed of claim 1 wherein each set of opposing sides has at least one channel extending therethrough.

9. The bed of claim 1 wherein said cavity has a constant rectangular horizontal cross-section throughout its extent.

10. The bed of claim 7 wherein said cavity has a rectangular horizontal cross-section throughout its extent.

11. The bed of claim 10 wherein each set of opposing sides has at least one channel extending therethrough.

12. The bed of claim 9 wherein said sides, at their respective apexes, define said cavity at its uppermost extent.

13. The bed of claim 12 wherein said rectangular base has adjacent sides of equal length.

14. The bed of claim 12 wherein said rectangular base has adjacent sides of unequal length.

15. The bed of claim 14 wherein there are a plurality of anodes, said anodes being elongated and having their longitudinal axes lying substantially in a single plane and substantially paralleling one side of said base, said single plane being substantially parallel to said base.

16. The bed of claim 15 wherein said rectangular base has adjacent sides of unequal length and wherein said longitudinal axes parallel the shorter of said adjacent sides.

17. The bed of claim 1 wherein said housing is of concrete.

18. The bed of claim 16 wherein said housing is of concrete.

19. The bed of claim 1 wherein there are a plurality of anodes which are in parallel electrical connection with said source of DC electrical current.

* * * * *